US009454952B2

(12) United States Patent
Tzirkel-Hancock et al.

(10) Patent No.: US 9,454,952 B2
(45) Date of Patent: Sep. 27, 2016

(54) SYSTEMS AND METHODS FOR CONTROLLING NOISE IN A VEHICLE

(71) Applicant: GM GLOBAL TECHNOLOGY OPERATIONS LLC, Detroit, MI (US)

(72) Inventors: Eli Tzirkel-Hancock, Ra'anana (IL); Scott M. Reilly, Southfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 25 days.

(21) Appl. No.: 14/538,152

(22) Filed: Nov. 11, 2014

(65) Prior Publication Data

US 2016/0133244 A1 May 12, 2016

(51) Int. Cl.

*G10K 11/16* (2006.01)
*G10K 11/175* (2006.01)
*G10L 21/0208* (2013.01)

(52) U.S. Cl.

CPC ..... *G10K 11/175* (2013.01); *G10L 21/0208* (2013.01); *G10K 2210/128* (2013.01); *G10K 2210/1281* (2013.01); *G10K 2210/1282* (2013.01)

(58) Field of Classification Search

CPC ..... G10K 2210/128; G10K 2210/1281; G10K 2210/1282; G10K 11/175
USPC ..... 381/71.1–71.4, 71.6, 71.12
See application file for complete search history.

(56) References Cited

U.S. PATENT DOCUMENTS 4,947,435 A 8/1990 Taylor
5,251,262 A 10/1993 Suzuki et al.
7,693,712 B2 4/2010 Gaeta et al.
8,447,045 B1 * 5/2013 Laroche ..... A61F 11/14 381/71.1
2008/0224863 A1 * 9/2008 Bachmann ..... G08B 13/1609 340/541
2014/0112490 A1 * 4/2014 Caillet ..... G10K 11/1784 381/71.4
2014/0270225 A1 * 9/2014 Gether ..... G10K 11/1788 381/71.6
2015/0243271 A1 * 8/2015 Goldstein ..... G10L 21/0208 381/71.6

FOREIGN PATENT DOCUMENTS

EP 1124218 A1 8/2001
JP 2007002393 A 1/2007

OTHER PUBLICATIONS

Castro, B., et al., "Subband Scale Factor Ambiguity Correction Using Multiple Filterbanks." Proc. International Workshop on Acoustic Echo and Noise Control (IWAENC), Aug. 2010.

* cited by examiner

*Primary Examiner* — Disler Paul
(74) *Attorney, Agent, or Firm* — Lorenz & Kope, LLP

(57) ABSTRACT

Methods and apparatus are provided for controlling noise in a compartment. The audio system includes an error microphone configured to receive sounds and generate an error signal corresponding to the received sounds. A processor in communication with the error microphone is configured receive the error signal from the error microphone and generate a noise-canceling signal based at least in part on the error signal and an acoustic transfer function. The audio system also includes a loudspeaker in communication with the processor to receive the noise-canceling signal and produce a noise-canceling sound wave based on the noise-canceling signal. The processor is also configured to receive at least one audio signal different from the error signal and to modify the acoustic transfer function utilizing the at least one audio signal.

17 Claims, 3 Drawing Sheets

SYSTEMS AND METHODS FOR CONTROLLING NOISE IN A VEHICLE

TECHNICAL FIELD

The technical field generally relates to systems and methods for controlling noise in a vehicle, more particularly to active noise control systems and methods for a motor vehicle.

BACKGROUND

Active noise control ("ANC") systems may be implemented in a motor vehicle, e.g., an automobile, to reduce the amount of noise and undesired sounds that occupants are subjected to. Such systems typically include a microphone to receive noise and at least one loudspeaker to produce an inverted signal corresponding to the noise to be canceled. The ANC system may utilize a transfer function, specifically an acoustic transfer function, to mathematically represent the spatial characteristics of a cabin of the vehicle. In generating a noise canceling signal that is sent to the loudspeaker, the ANC system utilizes a signal generated by the microphone and the acoustic transfer function.

The acoustic transfer functions utilized in many prior art ANC systems are estimated at vehicle development time and remain fixed thereafter. As such, the ANC systems may not be able to account for changing conditions of the cabin including, but not limited to, the number of occupants, the position of the occupants, and aging of the components of the cabin. Accordingly, overall performance of the ANC system suffers.

Accordingly, it is desirable to provide systems and methods for variably controlling noise in a cabin of a vehicle. Furthermore, other desirable features and characteristics of the present invention will become apparent from the subsequent detailed description and the appended claims, taken in conjunction with the accompanying drawings and the foregoing technical field and background.

SUMMARY

In one embodiment, an audio system includes an error microphone configured to receive sounds and generate an error signal corresponding to the received sounds. A processor in communication with the error microphone is configured receive the error signal from the error microphone and generate a noise-canceling signal utilizing the error signal and an acoustic transfer function. The audio system also includes a loudspeaker in communication with the processor to receive the noise-canceling signal and produce a noise-canceling sound wave based on the noise-canceling signal. The processor is also configured to receive at least one audio signal different from the error signal and to modify the acoustic transfer function utilizing the at least one audio signal.

In one embodiment, a method is provided for controlling noise in a compartment. The method includes receiving an error signal from an error microphone. The method also includes generating a noise-canceling signal based at least in part on the error signal and an acoustic transfer function. A noise-canceling sound wave is produced from a loudspeaker based on the noise-canceling signal. The method further includes receiving at least one audio signal different from the error signal. The acoustic transfer function is modified utilizing the at least one audio signal.

DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
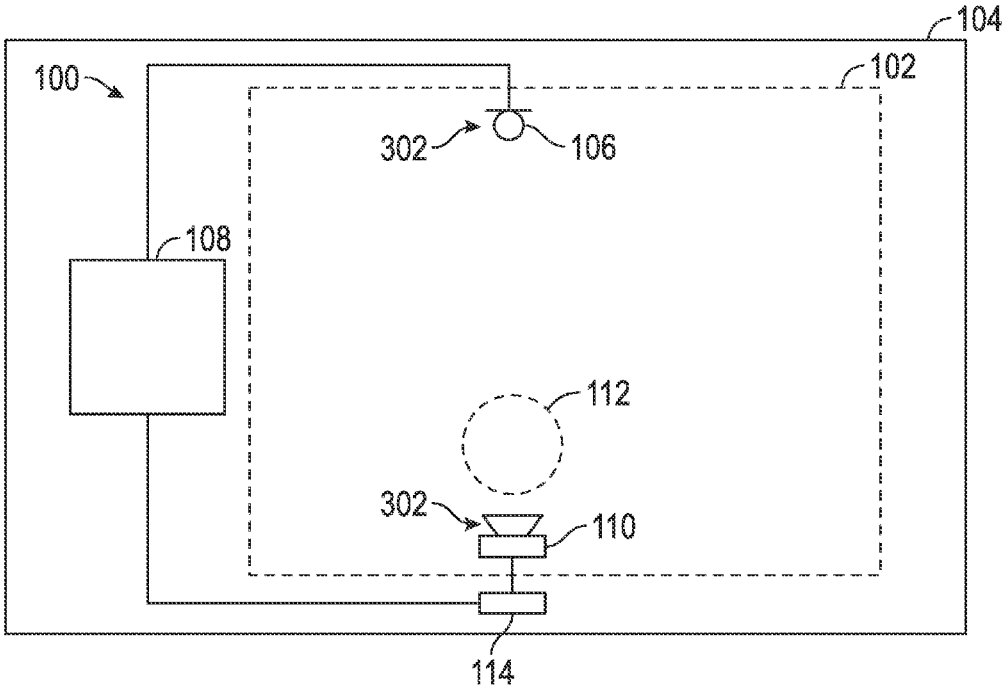
FIG. 1 is a block electrical diagram of a vehicle including a system for controlling noise in accordance with various embodiments.

The following detailed description is merely exemplary in nature and is not intended to limit the application and uses. Furthermore, there is no intention to be bound by any expressed or implied theory presented in the preceding technical field, background, brief summary or the following detailed description.

Referring to the figures, wherein like numerals indicate like parts throughout the several views, an audio system 100 and method 500 of controlling noise in a compartment 102, e.g., a passenger compartment or a cabin, are shown and described herein. In the exemplary embodiment, the compartment 102 is part of a vehicle 104 and the vehicle 104 is an automobile (not separately numbered). It should be appreciated, however, that the system 100 and/or method 500 described herein may be implemented in other types of vehicles 104, including, but not limited to, aircraft and watercraft. Furthermore, the system 100 and method 500 may be implemented in non-vehicle applications, e.g., an office environment.

Referring to FIG. 1, the audio system 100 includes at least one error microphone 106 configured to receive sounds. The system may 100 include multiple error microphones 106, such as in the exemplary embodiment shown in FIG. 2. However, for ease of readability, the error microphones 106 may be referred to a single error microphone 106 herein. Microphones generate signals corresponding to sounds they receive, as is appreciated by those skilled in the art. Specifically, in the audio systems 100 described herein, the error microphone 106 generates an error signal corresponding to the received sounds.

The audio system 100 also includes a processor 108. The processor 108 of the exemplary embodiments is implemented with at least one semiconductor-based microprocessor capable of performing calculations and executing instructions (i.e., running a program). The processor 108 of the exemplary embodiments includes a digital signal processor ("DSP") configured to convert and process analog signals. However, it should be appreciated that the processor 108 may be implemented with any number of suitable devices, schemes, or configurations, as is readily appreciated by those skilled in the art.

The processor 108 is in communication with the error microphone and is configured to receive the error signal from the error microphone 106. The processor 108 is configured to generate a noise-canceling signal based at least in part on an error signal and an acoustic transfer function. One possible acoustic transfer function may be expressed as $a(\omega)\cdot\exp(-j\cdot p(\omega)))$ where $\omega$ is a certain frequency, $a(\omega)$ is the acoustic path attenuation at that frequency, and $p(\omega)$ is the phase shift at that frequency. It should be appreciated that generating the noise-canceling signal may utilize an acoustic transfer functions either directly or indirectly. For example, utilizing an acoustic transfer function indirectly may be utilized with an inverse system.

Figure 2:
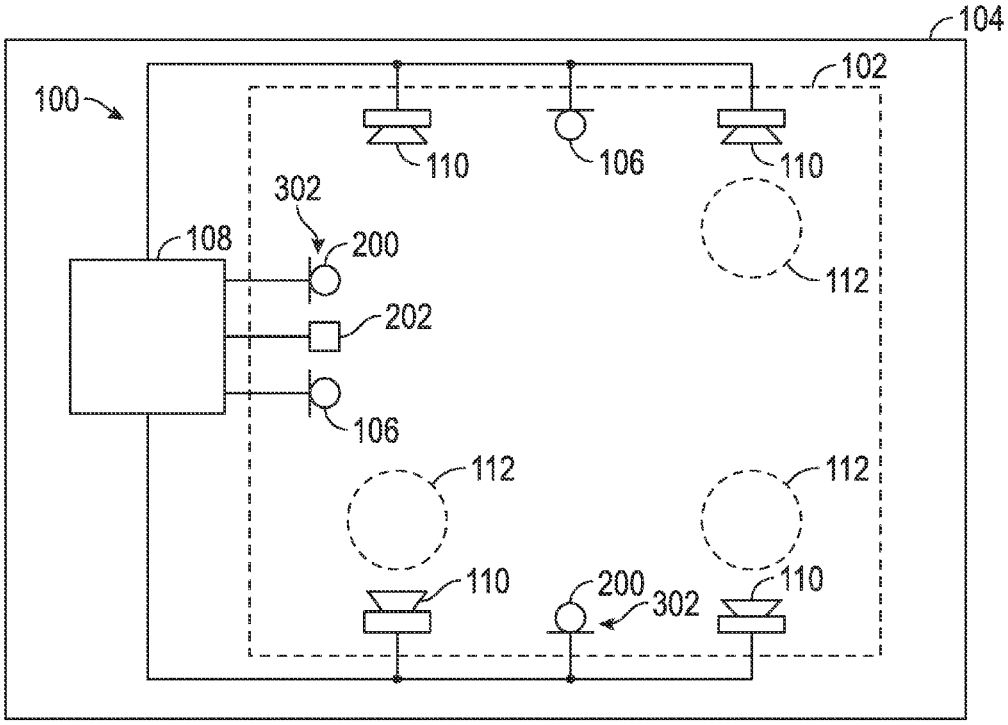
FIG. 2 is a block electrical diagram of the vehicle including the system with a plurality of speakers and error microphones in accordance with various embodiments.

The audio system 100 also includes at least one loudspeaker 110, as shown in FIG. 1. Of course, multiple loudspeakers 110 may be implemented, as is shown in FIG. 2. However, for ease of readability, the loudspeakers 110 may be referred to a single loudspeaker 110 herein. Loudspeakers generate sounds corresponding to signals they receive, as is appreciated by those skilled in the art. Specifically, in the audio systems 100 described herein, the loudspeaker 110 generates a noise-canceling sound corresponding to the received noise-canceling signal.

The processor 108 is also configured to modify the acoustic transfer function to compensate for variability in the passenger compartment 102. These variabilities may include, but are certainly not limited to, the presence and/or location of occupants 112, the presence and/or location of other objects (not shown), and the aging of materials and/or other components forming the compartment 102.

In one example, the processor 108 is also configured to receive at least one audio signal different from the error signal from the error microphone 106. The processor 108 is further configured to modify the acoustic transfer function based at least in part on the at least one audio signal, as described in greater detail below.

In one embodiment, the processor 108 is configured to modify the acoustic transfer function utilizing speech produced by at least one of the occupants 112. More specifically, the processor 108 is configured to modify the acoustic transfer function based at least partially on the location of the occupant 112 that is speaking. The location of the occupant 112 need not be specifically determined, but rather a generalized or rough location may be utilized. An example of determining such a location is described further below.

Figure 3:
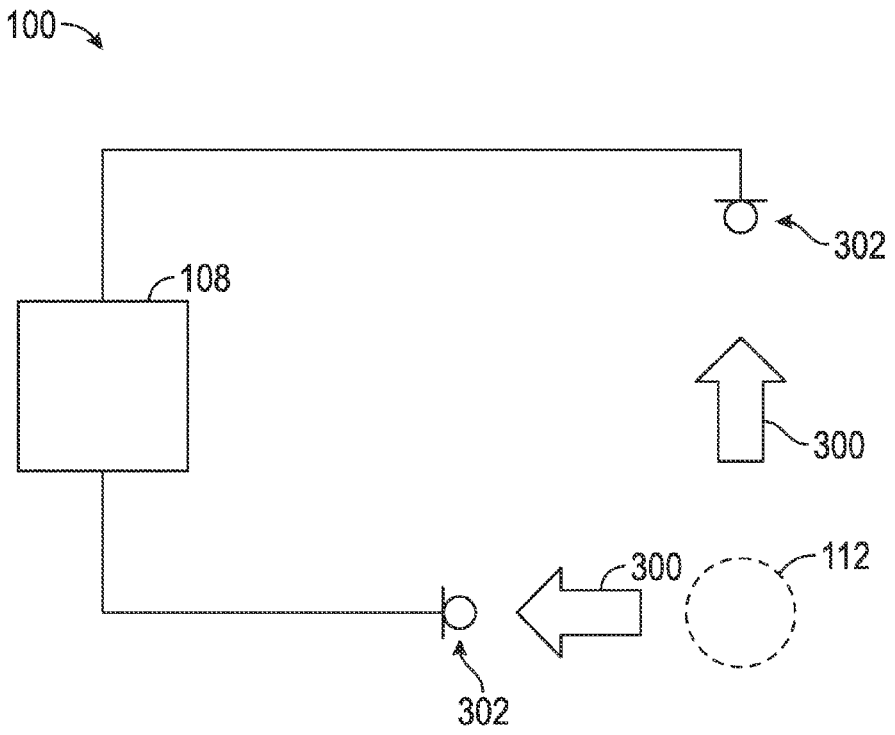
FIG. 3 is a block diagram of the system in accordance with various embodiments showing a plurality of speech sound waves.

In this embodiment, as shown in FIG. 3, speech sounds waves 300 are received at a plurality of audio input devices 302. The audio input devices 302 are disposed apart from one another, as also shown in FIG. 3. Each audio input device 302 generates a speech audio signal corresponding to the received speech sound waves. As such, multiple speech audio signals are generated by the audio input devices 302.

The audio input devices 302 may be implemented using various apparatuses. In the embodiment shown in FIG. 1, the audio input devices 302 are implemented with the error microphone 106 and the loudspeaker 110. In order to utilize the loudspeaker 110 as an audio input device 302, the system 100 includes a conditioning circuit 114 electrically coupled between the loudspeaker 110 and the processor 108. The conditioning circuit 114 is configured to generate one of the speech audio signals in response to the speech sound wave being received by the loudspeaker 110.

The audio input devices 302 may also be implemented using the error microphone 106. As such, the error microphone 106 that generates the error signal may also generate one of the speech audio signals. Of course, the error microphone 106 may simply generate one signal that is then sent to the processor 108, without internally differentiating between whether that signal is generated by noise (i.e., the error signal) or by speech of an occupant (i.e., the speech audio signal). The processor 108 may be configured to separate one signal from the error microphone 106 into the error signal and the speech audio signal. For instance, the processor 108 may be configured to sense speech patterns, i.e., the speech audio signal, and isolate those patterns accordingly. This may be accomplished by filtering out noise from the error signal provided by the error microphone 106, e.g., by using a notch filter to remove engine noise.

The audio input devices 302 may also be implemented with one or more additional microphones 200, separate from the error microphone 106 and/or the loudspeaker 110, as shown in FIG. 2. Each additional microphone 200 generates a speech audio signal which may be communicated to the processor 108.

In the embodiments shown in FIGS. 1-3, and as stated above, the processor 108 is configured to receive a plurality of speech audio signals different from the error signal. The processor 108 is also configured to modify the acoustic transfer function based at least in part on the plurality of speech audio signals.

In one technique, modifying the acoustic transfer function includes determining a location of the occupant 112 based on the plurality of speech sound waves and corresponding speech audio signals. Determining the location of the occupant 112 may be accomplished by comparing the timing of the different speech audio signals received from different audio input devices 302 with knowledge of the position of the audio input devices 302 with respect to the passenger compartment 102. That is, the location of the occupant 112 may be triangulated using the speech sound waves and known positions of the audio input devices 302.

To better determine the location of the occupant 112, the processor 108 may also be configured to determine that only one occupant 112 is speaking. Specifically, the processor 108 executes digital signal processing routines to determine if more than one speech pattern exists in the speech audio signals. In such a configuration, the processor 108 determines the position of the occupant 112 in response to the determination that only one occupant is speaking. For example, this can be based on signal level at the microphones 106. If the level in one microphone 106 is higher it may be concluded that only the speaking occupant 112 near that microphone 106 is active. Alternatively, delay and sum beamforming for the occupants 112 may be utilized.

By utilizing the location of the occupants 112, the system 100 can tailor noise-canceling signals and sounds for the particular occupants 112. As such, one loudspeaker 110 can emit a first noise-canceling signal and another loudspeaker 110 can emit a second noise-canceling signal in order to reduce the noise heard by the particular occupants 112.

The system 100 can further include a position sensor 202, as shown in FIG. 2. The position sensor 202 is in communication with the processor 108 and configured to determine more precise locations of the occupants 112. For example, the position sensor 202 may be a camera, radar system, sonar system, and/or a weight sensor. Of course, other techniques for implementing the position sensor 202 may be employed.

The acoustic transfer function may include a scale factor, as is appreciated by those skilled in the art. Modifying the scale factor will modify the acoustic transfer function. As such, the processor 108 may modify the scale factor based at least in part on the plurality of speech audio signals.

Figure 4:
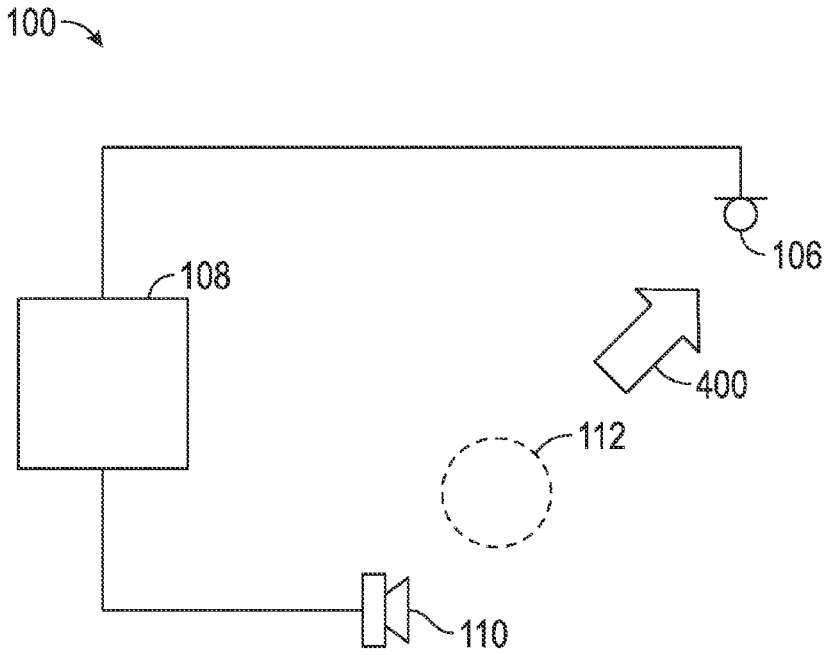
FIG. 4 is a block diagram of the system in accordance with various embodiments showing a known audio signal.

In another embodiment, as shown in FIG. 4, the processor 108 is configured to modify the acoustic transfer function based at least partially on a comparison between a received audio signal and a known audio signal 400. Specifically, the system 100 is configured to produce a known audio signal with the loudspeaker 110. This known audio signal 400 can be generated using a signal that is normally in use, e.g., a radio broadcast. Alternatively, the known audio signal 400 can be delivered coincidental to the radio signal, i.e., the known audio signal 400 could be masked by the radio signal, such that the occupant 112 may not notice the generation of the known audio signal 400 by the loudspeaker 110.

The system 100 of this embodiment is also configured to generate a received audio signal corresponding to the known audio signal. In the embodiment shown in FIG. 5, the error microphone 106 can be configured to generate the received audio signal, which is then sent to the processor 108. The processor 108 is configured to compare the received audio signal to the known audio signal 400 and then modify the acoustic transfer function based at least in part on the comparison between the received audio signal and the known audio signal. The comparison between the received audio signal and the known audio signal may be accomplished by comparing attenuation and phase shift at different frequencies.

For instance, when occupants 112 and other articles are placed in the passenger compartment 102 of the vehicle 104, they will affect the acoustic dynamics of the compartment 102. Accordingly, the transfer of the known audio signal 400 to the received audio signal will be altered by changes in the passenger compartment 102. The processor 108 is configured to compare the differences between the known and received audio signals and to modify the acoustic transfer function to compensate.

Figure 5:
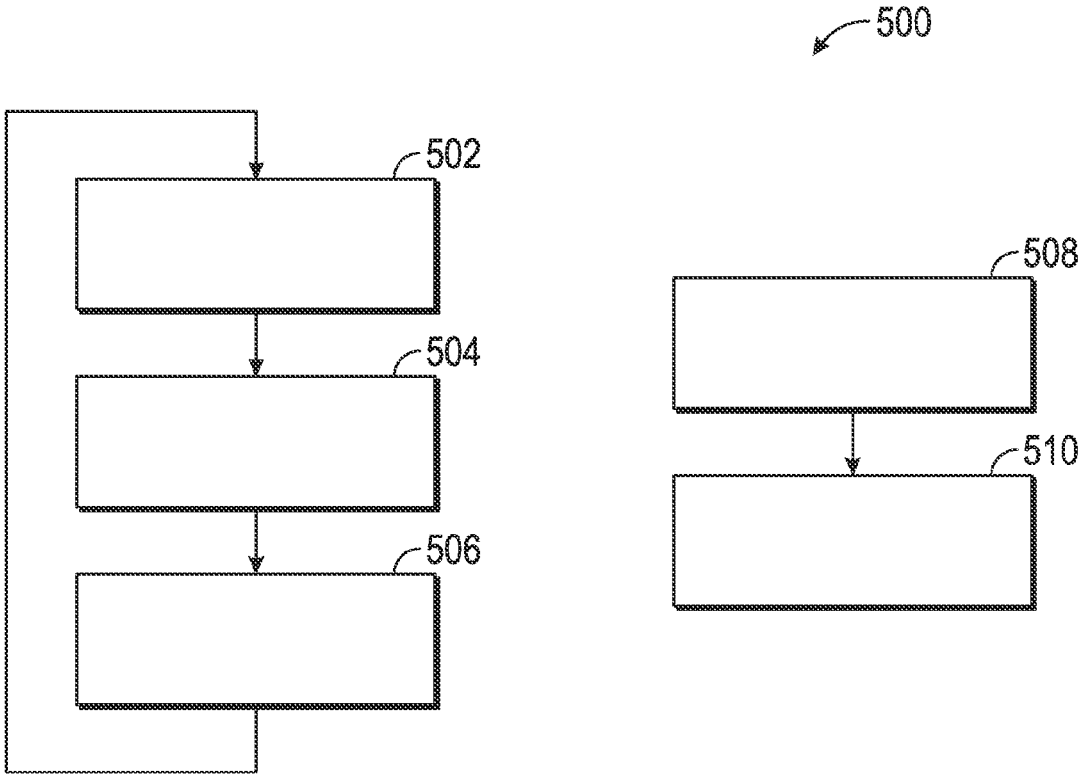
FIG. 5 is a flowchart of a method for controlling noise in accordance with various embodiments.

The method 500 of controlling noise in the passenger compartment 102 of the vehicle 104 may be better appreciated with reference to FIG. 5. In block 502, the method 500 includes receiving an error signal from an error microphone 106. The method 500 continues, at 504, with generating a noise-canceling signal based at least in part on the error signal and an acoustic transfer function. The method 500 further includes, at 506, producing a noise-canceling sound wave from a loudspeaker based on the noise-canceling signal. This process (502, 504, and 506) repeats itself as long as noise control is desired, e.g., whenever the vehicle 104 is operating.

Before, during, or after the noise control process (502, 504, and 506) described above, the method 500 also includes, at 508, receiving at least one audio signal different from the error signal. As described above, in one embodiment, the at least one audio signal may be a plurality of speech audio signals produced by the occupant 112. In another embodiment, the at least one audio signal may be a known audio signal 400.

The method 500 further includes, at 510, modifying the acoustic transfer function based at least in part on the at least one audio signal. In one embodiment, the acoustic transfer function is modified based on the presence or location of the occupant 112 as determined by comparing the plurality of speech audio signals. In another embodiment, the difference between the known and received signals is utilized to modify the acoustic transfer function.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method of controlling noise in a compartment, comprising:

receiving an error signal from an error microphone;

generating a noise-canceling signal based at least in part on the error signal and an acoustic transfer function;

producing a noise-canceling sound wave from a loudspeaker based on the noise-canceling signal;

receiving at least one audio signal different from the error signal;

receiving speech sound waves at a plurality of audio input devices;

generating a plurality of audio signals with the plurality of audio input devices different from the error signal;

determining a location of an occupant generating the speech sound waves based on the plurality of audio signals; and modifying the acoustic transfer function based on the plurality of audio signals and the location of the occupant.

2. The method as set forth in claim 1, wherein receiving speech sound waves comprises receiving a speech sound wave at the error microphone.

3. The method as set forth in claim 1, wherein receiving speech sound waves comprises receiving a speech sound wave at the loudspeaker.

4. The method as set forth in claim 1, wherein receiving speech sound waves comprises receiving a speech sound wave at an additional microphone.

5. The method as set forth in claim 1, further comprising determining when only one occupant is speaking; and wherein determining a location of an occupant generating the speech sound waves is further defined as determining a location of the occupant generating the speech sound waves based on the plurality of audio signals in response to the determination that only one occupant is speaking.

6. The method as set forth in claim 1, further comprising:

producing a known audio signal with the loudspeaker;

generating a received audio signal with the error microphone corresponding to the known audio signal;

wherein modifying the acoustic transfer function comprises:

comparing the received audio signal to the known audio signal; and modifying the acoustic transfer function utilizing the comparison between the received audio signal and the known audio signal.

7. The method as set forth in claim 1 wherein the acoustic transfer function includes a scale factor and wherein modifying the acoustic transfer function is further defined as modifying the scale factor based on the plurality of audio signals.

8. An audio system, comprising:

an error microphone configured to receive sounds and generate an error signal corresponding to the received sounds;

a processor in communication with said error microphone and configured to:

receive the error signal from said error microphone;

generate a noise-canceling signal based on the error signal and an acoustic transfer function; and a loudspeaker in communication with said processor to receive said noise-canceling signal and produce a noise-canceling sound wave based on the noise-canceling signal, wherein said processor is further configured to:

receive at least one audio signal different from the error signal, the at least one audio signal further defined as a plurality of audio signals corresponding to speech sound waves;

determine a location of an occupant generating the speech sound waves based on the plurality of audio signals; and modify the acoustic transfer function based on the plurality of audio signals and the location of the occupant.

9. The audio system as set forth in claim 8, wherein said error microphone is configured to receive at least one speech sound wave and generate at least one of the plurality of audio signals.

10. The audio system as set forth in claim 8, further comprising a conditioning circuit electrically coupled between said loudspeaker to said processor and configured to generate at least one of the plurality of audio signals in response to at least one speech sound wave received by said loudspeaker.

11. The audio system as set forth in claim 8, further comprising an additional microphone in communication with said processor and configured to generate at least one of the plurality of audio signals in response to receiving at least one speech sound wave.

12. The audio system as set forth in claim 8, wherein said processor is further configured to:

determine when only one occupant is speaking; and determine the location of the occupant generating the speech sound waves based on the plurality of audio signals in response to the determination that only one occupant is speaking.

13. The audio system as set forth in claim 8, wherein said loudspeaker is configured to produce a known audio signal;

wherein said error microphone is configured to generate a received audio signal with corresponding to the known audio signal;

wherein said controller modifies the acoustic transfer function by:

comparing the received audio signal to the known audio signal; and modifying the acoustic transfer function utilizing the comparison between the received audio signal and the known audio signal.

14. The audio system as set forth in claim 8, wherein the acoustic transfer function includes a scale factor and wherein said processor is configured to modify the scale factor based on the plurality of audio signals.

15. A vehicle, comprising:

a passenger compartment; and an audio system comprising:

an error microphone configured to receive sounds within the passenger compartment and generate an error signal corresponding to the received sounds;

a processor in communication with said error microphone and configured to:

receive the error signal from said error microphone;

generate a noise-cancelling signal based on the error signal and an acoustic transfer function; and a loudspeaker in communication with said processor to receive said noise-canceling signal and produce a noise-cancelling sound wave based on the noise-cancelling signal;

wherein the at least one audio signal is further defined as a plurality of audio signals corresponding to speech sound waves and said processor is further configured to:

receive at least one audio signal different from said error signal;

modify the acoustic transfer function based at least in part of the at least one audio signal;

determine a location of an occupant generating the speech sound waves based on the plurality of audio signals; and modify the acoustic transfer function based on the location of the occupant.

16. The vehicle as set forth in claim 15, said error microphone is configured to receive at least one speech sound wave and generate at least one of the plurality of audio signals.

17. The vehicle as set forth in claim 15, further comprising a conditioning circuit electrically coupled between said loudspeaker to said processor and configured to generate at least one of the plurality of audio signals in response to at least one speech sound wave received by said loudspeaker.

* * * * *